US005178090A

United States Patent [19]

Carter

[11] Patent Number: 5,178,090

[45] Date of Patent: Jan. 12, 1993

[54] UNDERWATER DIVING PLANE

[76] Inventor: Brian M. Carter, 1007 S.E. 2nd Crt, #5, Ft. Lauderdale, Fla. 33301

[21] Appl. No.: 650,162

[22] Filed: Feb. 4, 1991

[51] Int. Cl.[5] ..... B63C 11/46

[52] U.S. Cl. ..... 114/315; 114/245; 114/253

[58] Field of Search ..... 114/315, 245, 253; 441/65

[56] References Cited

U.S. PATENT DOCUMENTS

| | | | |
|---|---|---|---|
| 2,948,251 | 8/1960 | Replogle | 115/6.1 |
| 3,101,691 | 8/1963 | Wendt | 114/16 |
| 3,139,055 | 6/1964 | Nutting | 114/16 |
| 3,638,598 | 2/1972 | Vlad | 114/16 A |
| 4,624,207 | 11/1986 | King | 114/315 |

FOREIGN PATENT DOCUMENTS

| | | | |
|---|---|---|---|
| 1144305 | 3/1969 | United Kingdom | 114/315 |

*Primary Examiner*—Sherman Basinger
*Attorney, Agent, or Firm*—Oltman and Flynn

[57] ABSTRACT

An underwater diving plane has a main frame forming an isoceles triangle, having a base part, two side legs of equal length and an apex; a detachable transverse axle which is pivotally connected to the main frame, having two ends and two main planes each fixedly attached to the axle; a foreplane attached to the frame proximal to the apex; and a tow force transition cable to allow the planes stable planing action.

13 Claims, 3 Drawing Sheets

UNDERWATER DIVING PLANE

The invention relates to an underwater diving plane arranged to be towed with a diver steering the diving plane by means of two main planes pivotally attached to the diving plane.

BACKGROUND AND PRIOR ART

With increasing public interest in the diving sports and underwater exploration it is known to have an underwater diving device being towed by a vessel on the surface, arranged to have a diver holding onto the device and steering it by means of suitable steering surfaces attached to the device.

Many known devices have certain drawbacks in regard to the safety of the diver, in that they have unsafe features that can possibly trap the diver between the various parts of the device. Furthermore, the known designs lack vertical stability in that very small movements of the steering wings can cause significant vertical, rapid movements of the device with the diver holding on to it.

It is accordingly a primary object of the instant invention to provide an underwater diving design that does not in any manner expose the diver to be trapped in the device while under water.

It is a further object to provide a diving design that has a high degree of vertical stability and accurate helm control during diving, and it is a still further object to provide a diving design that has soft padding in the areas of the device that rest against the diver's body during diving to avoid diminished blood circulation and resulting numbness.

It is a further object to provide a dynamically designed form so that there is minimum turbulence around the diver.

It is still another object to provide a diving device that can be disassembled into smaller parts that are readily transportable.

It is a further object to provide a safety transposed tow force.

SUMMARY OF THE INVENTION

In accordance with the invention there is provided an underwater diving plane, which has a main frame forming an isoceles triangle, having a base part, two side legs of equal length and an apex; a detachable transverse axle which is pivotally connected to the main frame, having two ends, two main planes, each fixedly attached to the axle; a foreplane attached to the frame proximal to the apex; and a tow force transition cable to allow the plane a stable planing action.

In accordance with a further feature there is provided an underwater diving plane, wherein the control handle has an axis parallel with the axle, and is affixed to the axle at its center to develop maximum helm force control and operator safety. The main planes define a first plane, the axis of the control handle defines a second plane intersecting the first plane in the axis of the axle, and wherein the first and second planes form an angle substantially equal to 50° facing away from the apex.

In accordance with a still further feature, there is provided an underwater diving plane, wherein the foreplane has an elongate shape defining a long axis disposed transversely on the frame.

According to another feature the diving plane has a tow force transition cable to develop a stable planing action. The diving plane according to the invention has a base part which forms a torso rest for the diver, which has a padding on the base part of the frame and wherein the padding further extends from the base part onto a part of the side legs that are proximal to the base part.

According to still another feature, the underwater diving plane according to the invention has padding which includes an inner part of neoprene and an outer cover part of rubber.

The underwater diving plane according to the invention may further include two axle clamps for pivotally receiving the axle, wherein each of the axle clamps are fixedly attached to a respective side leg of the main frame in a position proximal to the padding.

The underwater diving plane according to the invention does further include two parallel support struts for attaching the control handle to the axle, and wherein the main frame, the axle, the main planes and the control handle are made of corrosion resistant material, which may advantageously be stainless steel, aluminum or plastic, and wherein the corrosion resistant material includes aluminum or aluminum tubing of alloy type 6062, and wherein the tubing frame and axle helm handle are closed to water to maintain buoyancy in submerged condition.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
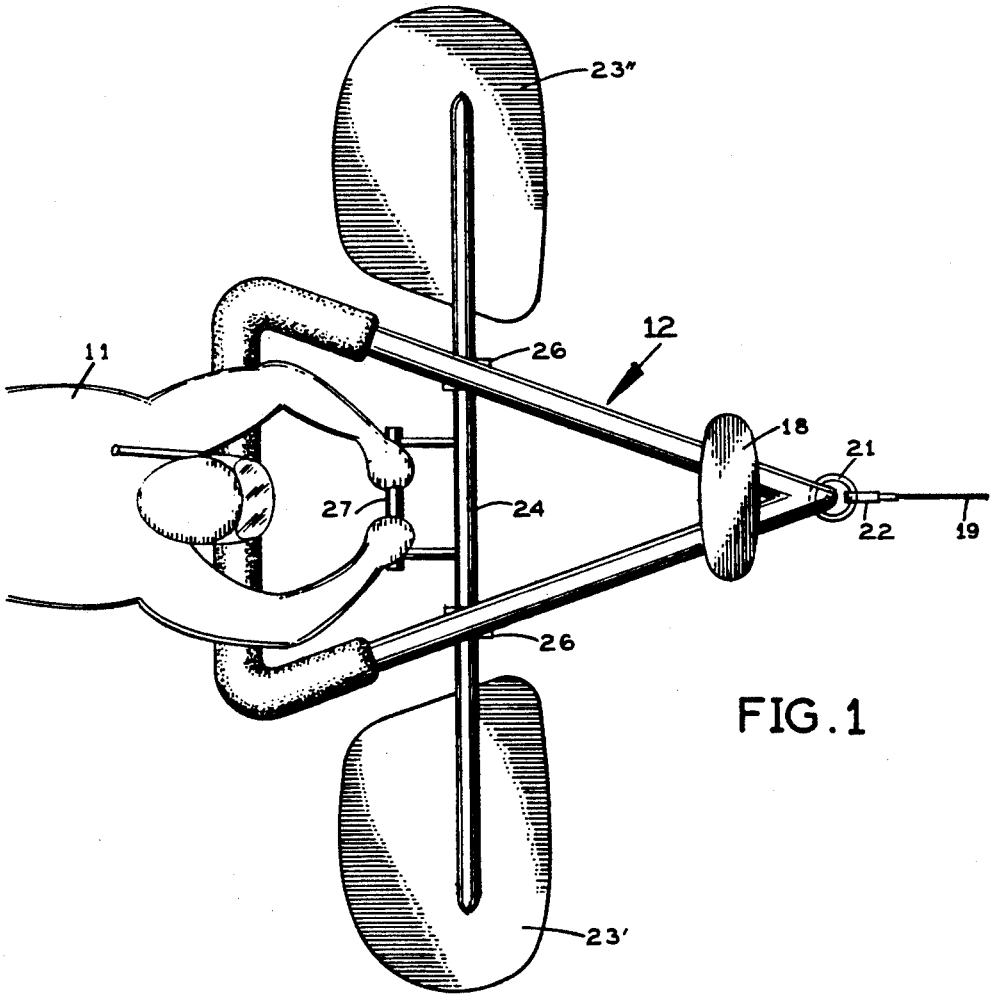
FIG. 1 is a plan view of the invention showing a diver with the diving plane.
Figure 2:
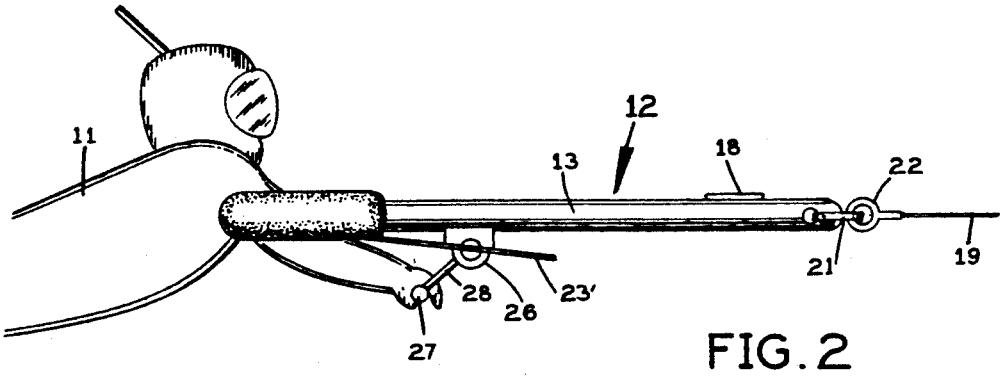
FIG. 2 is an elevational view of the invention showing a diver seen from the side using the invention.

FIGS. 1 and 2 show a diver 11 diving with the diving plane, generally at 12.

Figure 3:
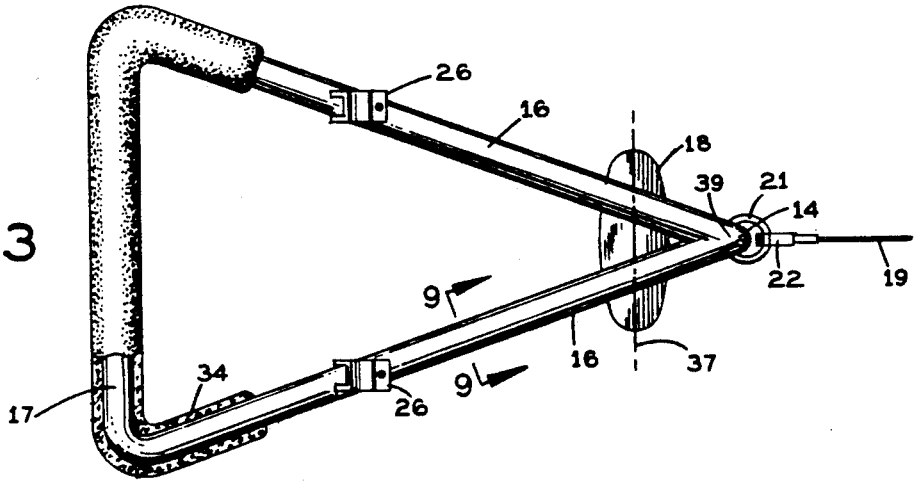
FIG. 3 is a plan fragmentary detail of the invention showing the main frame of the diving plane.

The diving plane has a main frame 13 forming an isoceles triangle, better seen in FIG. 3, having an apex 14, two side legs 16 of equal length, and a base part 17.

Figure 4:
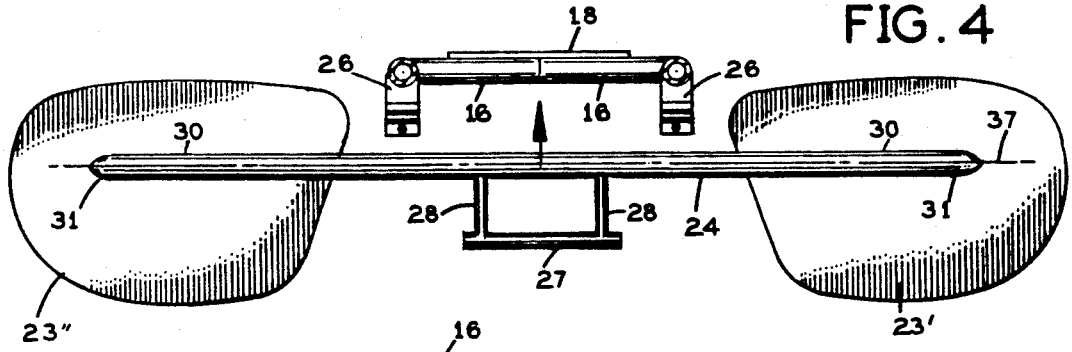
FIG. 4 is another fragmentary detail of the invention showing the two main planes attached to their common axle.
Figure 7:
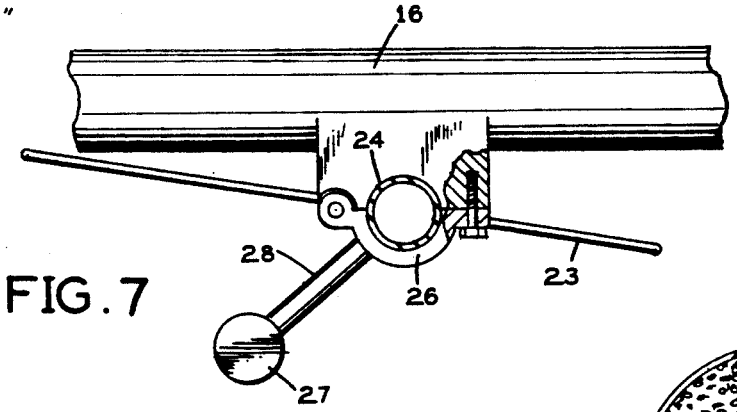
FIG. 7 is an elevational fragmentary detail showing the axle clamp.
Figure 5:
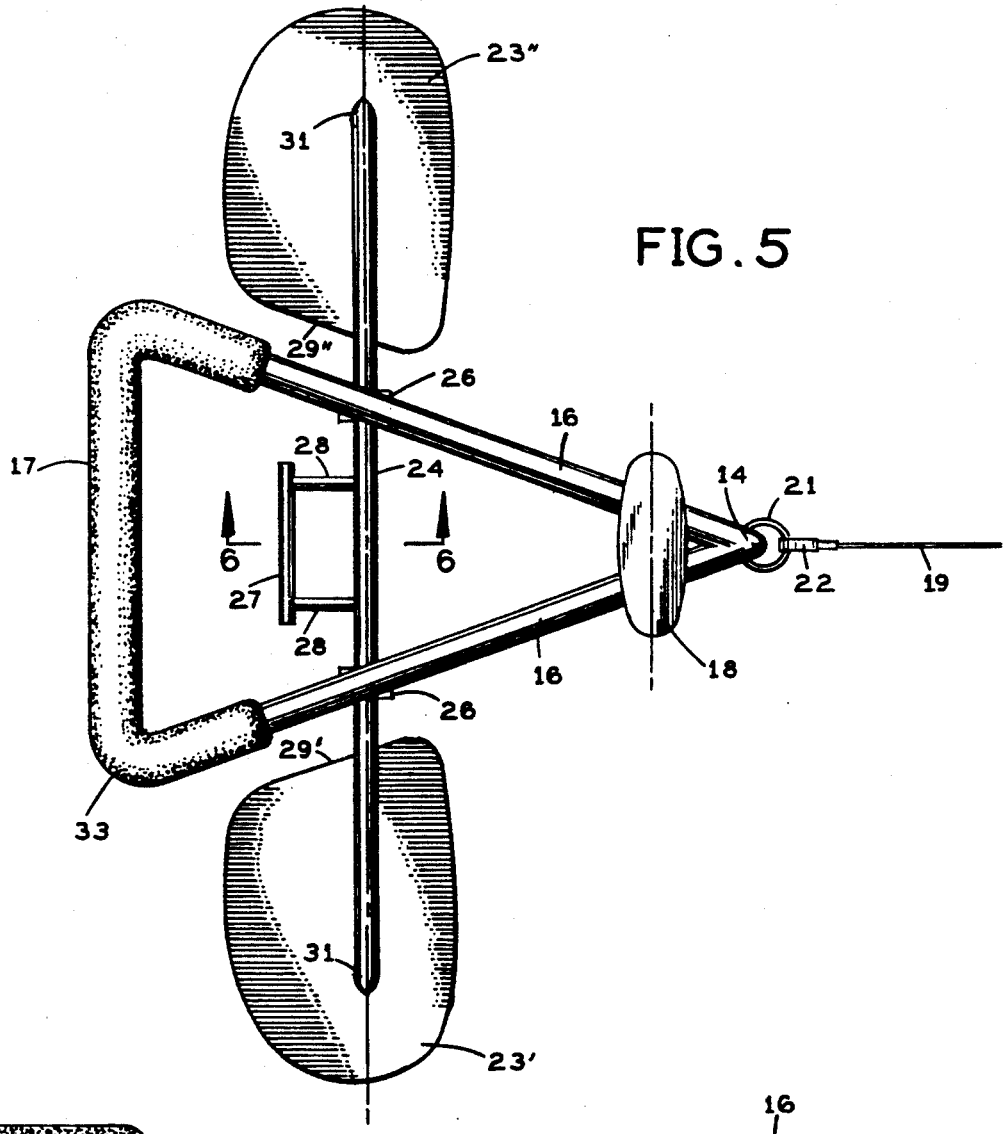
FIG. 5 is a plan view of the invention showing the assembled structure.

An elongate foreplane 18 is mounted transversely on the main frame side legs 16, proximal to the apex 14. A towing line, e.g. in the form of a nylon rope 19 is attached via a flexible towing ring 21 (tow force transition cable) and a snap shackle 22 to the apex of the diving plane in order to provide a degree of elastic shock absorption. FIG. 4 shows two diving main planes 23', 23'' of flat material attached to a common axle 24 of tubular material. The axle 24 fits pivotally in two axle clamps 26 mounted on the side legs 16, as shown in FIGS. 5 and 7. A control handle 27 is attached to the axle 24 by means of two parallel support struts 28.

The two main planes 23', 23'' are of generally rounded form with substantially straight inside edges 29', 29'', that are substantially parallel with the corresponding side legs 16, as best seen in FIG. 5.

As seen in FIG. 4 the end sections 31 of the axle 24 are advantageously attached by welding into slots 30 formed into the main planes 23', 23'' in a line slightly forwardly located on the main planes 23', 23'' for greater steering stability.

Figure 6:
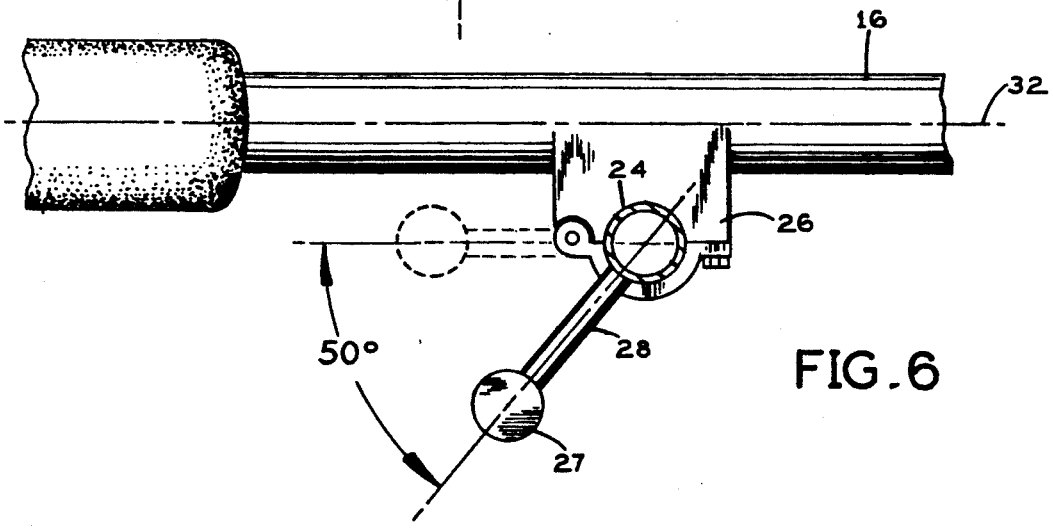
FIG. 6 is an elevational fragmentary detail view seen along the line 6—6 of FIG. 5, showing the angular position of the control handle.

The control handle 27 is positioned below a plane defined by the main planes 23', 23'' as shown in FIG. 6, wherein the handle 27 is seen located below the horizontal plane 32, indicated by a stippled line 32, and parallel with and rearwardly offset from the axle as shown, defining with the axis of the axle 24 a second plane that forms an angle of substantially 50 degrees with the plane defined by the main planes 23', 23''.

Figure 8:
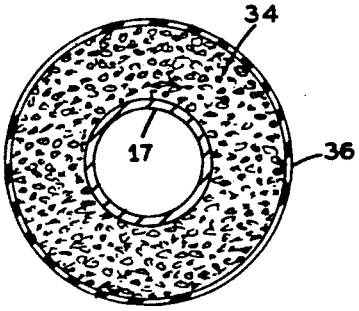
FIG. 8 is a cross-section through the base part, showing the padding thereon.

A soft padding 33 is installed around the base part 17, extending forward on the side legs 16 almost all the way to the clamps 26. The padding advantageously includes an inner layer of two inch soft neoprene 34, coated with a thick external rubber jacket 36 as seen in FIG. 8.

The axle 24 is mounted detachably on the side legs 16 by means of clamps 26, so that the diving plane can be disassembled for easy transportation by opening the clamps 26, as seen in FIG. 7.

Figure 9:
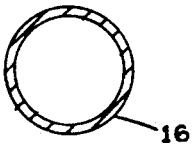
FIG. 9 is a cross-section of the tubular elements shown in FIGS. 3 and 4 seen along the line 9—9 in FIGS. 3 and 4.

The main frame 13 and the axle 24 are advantageously made of corrosion-resistant materials such as stainless steel tubing, or aluminum tubing as shown in FIG. 9 showing cross sections marked in FIGS. 3 and 4 along lines 9—9, aluminum alloy no. 6062, which is highly corrosion resistant to salt water and is of light weight. The tubes are sealed watertight so that no water can get inside them, which gives buoyancy to the entire assembly. Suitable plastic may also be used for making at least parts of the diving plane.

The structural dimensions of the diving plane are not strictly limited to certain sizes, but the following dimensions have been found to be very workable.

The isoceles base angles of the main frame are 70° angles; the length of the base part 17 is 2'-10½"; the distance from the apex 14 to base part 17 is 3'-11"; the distance from the center of the base part 17 to the axis 37 of the axle 24 in direction toward the apex is 1'-5"; the distance from the apex 14 to the centerline 37 of the foreplane 18 is 6½". A thick rubber jacket 39 covers the frame structure adjacent to the apex 14. The rubber jacket reaches back to a line 41 just behind the rear edge of the foreplane 18. The length of the axle 24 is 4'-0"; the overall main plane span is 5'-10". Each main plane is 2'-1" in direction parallel with the axle 24, and 1'-2¼" in direction perpendicular to the axle 24. The axle 24 is made of 1½" aluminum alloy type 6062, with wall thickness ⅛". The control handle 27 is 1½" diameter, 6" long, and is attached centrally located on the axle 24 at a distance of 2½" therefrom. The outer edge aft angle of each main plane has a 30° apex from the base.

The central handle is coated with a thick rubber jacket that also covers the parallel support struts 28 and extends along the axle 24 for a distance of about 8½" from its center.

All tubing is water tightly sealed, and is buoyant, so that the entire diving plane rises to the surface when not being towed.

In operation the diving plane is towed through the water by a surface craft, and is maneuvered and controlled by a diver by means of the control handle 27 by moving the handle up or down. During operation the diver rests with his torso on the padded straight base part 17 of the main frame. The shape and position of the control handle enables the diver to easily control the diving plane even with one hand. The configuration of the main frame and the control handle completely eliminates any danger of the diver being entrapped in the diving plane.

During towing, the forward part of the main frame, including the rubber-covered apex creates a quiet water zone around the head and torso of the diver, which produces a harmonious water flow over the entire form. The main dive plane control handle is located in the quiet water zone, so that only little drag and pressure variation is encountered.

In operation the action of the foreplane and main plane creates a dynamic condition that causes the diving plane to glide along any glide angle desired by the diver. This controlled action is produced by pulling the lever handle to a dive angle desired or pushing it to the desired angle of assent.

The dive plane has a highly responsive control. It can glide just inches from the bottom or just below the surface at snorkel depth. A porpoise-like swimming action can be produced by a rhythmic push pull action with the lever helm. The dive plane can also perform submerged acrobatics by employing the diver's swim fins as a tail helm. The control handle can be controlled easily with one hand leaving the other hand for a variety of other employments.

The size and form of the isoceles triangle of the frame is very important in the overall design concept in that it produces a flow action cone of water around the passenger. This still water zone around the diver's head and upper torso allows him to move his head in any direction for viewing without vibrations to diving mask or breathing gear.

The unique triangular form, size and buoyant character of the diving plane when activated with the foreplane and main plane inner action, produces a highly accurate and low stress controlled ride for the diver.

The diver is free to brake contact with the dive plane by simply releasing the control handle and raising his elbows over the torso bar. The handle is held by hand grip and can be released at any moment. The elbows grip the torso bar at each base angle corner and the upper torso rests on the base part 17.

The dive plane is an excellent submersible device for search and rescue, exploration, oceanography, survey-underwater construction besides recreation. It can be fitted with detachable instruments or marker buoys. It can carry a load that is detachable. The diver can leave the diving plane at any time and it will return to the surface.

I claim:

1. An underwater diving plane comprising a main frame forming an isoceles triangle having a base part, two side legs of equal length and an apex; a transverse axle pivotally connected to said main frame having two ends, two main planes, each fixedly attached to respective ends of said axle, a control handle fixedly attached to said axle, a foreplane fixedly attached to said main frame disposed transversely to the main frame proximal to said apex, and a force transition loop attached to said apex.

2. An underwater diving plane according to claim 1, wherein said control handle has an axis parallel with said axle, said main planes define a first plane, said axis of the control handle defines a second plane intersecting said first plane in an axis of said axle, and said first and second planes form an angle substantially equal to 50° facing away from said apex.

3. An underwater diving plane according to claim 1, wherein there is a tow force transition cable with both ends attached to the two side legs just below the apex to provide a safe even tow force transition throughout the entire frame.

4. An underwater diving plane according to claim 1, wherein said foreplane has an elongate shape defining a long axis disposed transversely on said frame.

5. An underwater diving plane according to claim 1, wherein said base part forms a torso rest, including a padding on said base part.

6. An underwater diving plane according to claim 5, wherein said padding further extends from said base part onto a part of said side legs proximal to said transverse axle.

7. An underwater diving plane according to claim 6, wherein said padding includes an inner part of neoprene and an outer cover part of rubber.

8. An underwater diving plane according to claim 1, including two axle clamps for pivotally securing said axle to said side legs.

9. An underwater diving plane according to claim 1, including two parallel support struts for attaching said control handle to said axle.

10. An underwater diving plane according to claim 9, including a rubber coating covering said control handle, said parallel support struts and a central part of said axle.

11. An underwater diving plane according to claim 1, wherein said main frame, said axle, said main planes and said control handle are made of corrosion resistant material.

12. An underwater diving plane according to claim 11, wherein said main frame, said axle, and said control handle are made of aluminum tubing of alloy type 6062, and wherein said tubing is closed to water to maintain buoyancy in submerged conditions.

13. An underwater diving plane according to claim 1, including a rubber coating covering said apex.

* * * * *